US006895614B1

(12) United States Patent
Peck

(10) Patent No.: US 6,895,614 B1
(45) Date of Patent: May 24, 2005

(54) HUNTING MAT

(76) Inventor: Shawn Peck, 30209 - 116th St., Princeton, MN (US) 55371

( * ) Notice: Subject to any disclaimer, the term of this patent is extended or adjusted under 35 U.S.C. 154(b) by 0 days.

(21) Appl. No.: 10/361,476

(22) Filed: Feb. 10, 2003

(51) Int. Cl.[7] ..... A47C 27/14
(52) U.S. Cl. ..... 5/419; 5/420; 5/733
(58) Field of Search ..... 5/420, 417, 419, 5/413 R, 413 AM, 731, 733, 722, 723, 632

(56) References Cited

U.S. PATENT DOCUMENTS

| | | | | | |
|---|---|---|---|---|---|
| 112,175 | A | * | 2/1871 | Pack et al. | 5/727 |
| 132,686 | A | * | 10/1872 | Pack et al. | 5/722 |
| 433,905 | A | * | 8/1890 | Muller | 5/694 |
| 3,378,861 | A | * | 4/1968 | Lousberg | 5/733 |
| 3,469,882 | A | * | 9/1969 | Larsen | 297/118 |
| 3,639,927 | A | * | 2/1972 | Munch | 5/723 |
| 3,742,528 | A | * | 7/1973 | Munch | 5/723 |
| 3,798,686 | A | * | 3/1974 | Gaiser | 5/413 AM |
| 3,877,092 | A | * | 4/1975 | Gaiser | 5/413 R |
| 4,193,150 | A | * | 3/1980 | Vineberg | 5/632 |
| 4,574,397 | A | * | 3/1986 | Dennard | 2/69.5 |
| 4,601,076 | A | * | 7/1986 | Knobeloch | 5/413 R |
| 4,639,960 | A | * | 2/1987 | Quillen et al. | 5/710 |
| 4,853,993 | A | * | 8/1989 | Walpin et al. | 5/634 |
| 4,905,330 | A | * | 3/1990 | Jacobs | 5/705 |
| 4,987,625 | A | * | 1/1991 | Edelson | 5/657 |
| 5,044,031 | A | * | 9/1991 | Sherwood et al. | 2/69.5 |
| 5,048,137 | A | * | 9/1991 | Rogers | 5/731 |
| 5,117,517 | A | * | 6/1992 | Su | 5/709 |
| 5,448,790 | A | * | 9/1995 | Saro et al. | 5/657 |
| D376,945 | S | * | 12/1996 | Bonaddio et al. | D6/596 |
| 5,815,862 | A | * | 10/1998 | Rygiel | 5/632 |
| D422,829 | S | * | 4/2000 | Kritzinger | D6/595 |
| 6,334,442 | B1 | * | 1/2002 | Altamura | 128/845 |

FOREIGN PATENT DOCUMENTS

| | | | | |
|---|---|---|---|---|
| DE | 2734460 A1 | * | 2/1979 | A47C/27/16 |
| GB | 2177292 A | * | 1/1987 | A47G/9/08 |

* cited by examiner

*Primary Examiner*—Robert G. Santos
(74) *Attorney, Agent, or Firm*—Sherrill Law Offices, PLLC

(57) ABSTRACT

An article of commerce utilized by hunters as a support and barrier from the ground while hunting. The article of commerce comprises a mat and a support. The mat has a distal edge and a proximal edge. The proximal edge is longitudinally spaced from the distal edge in a first longitudinal direction. The support is attached to the mat along the proximal edge of the mat. The support has an inclined upper surface that slopes upwardly from the mat in the first longitudinal direction.

4 Claims, 3 Drawing Sheets

HUNTING MAT

FIELD OF INVENTION

The invention relates to mats used by hunters.

BACKGROUND

Hunting is often done in the spring and fall. These months can be cold and wet. Hunters often must sit or lie on the ground to keep out of sight of the wildlife while still maintaining the proper placement to discharge their weapon. The hunter must also often stay in one position for hours at a time. This can often lead to a hunter having to lie or sit on the cold, wet ground for extended periods of time. Staying in place and concealed for a period of time can become difficult due to the dampness and irregularities of the ground.

To protect themselves from the cold, damp ground hunters may use insulated mats as a barrier between them and the ground. This helps make an extended stay in one place more bearable to the hunter. The insulated mat most often used by hunters is a sleeping bag. When a hunter is lying upon the insulated mat, the hunter has a limited view of his surrounding. The head and shoulders of the hunter are positioned flat upon the mat providing an excellent view straight in to the sky. A pillow may be used to provide some angle to the view but it is still a limited view of the surroundings to the sides and front of the insulated mat. The positioning of the hunter on the mat may also place the hunter in an awkward position to discharge his or her weapon.

Portable shelters are another item used by hunters to protect them from the cold, damp ground while hunting. The shelters provide a barrier between the hunters and the ground and offer some protection from wind and precipitation. The insulated mats often resemble a tent like structure. The shelters also provide a more upright position for the hunters allowing them to more easily see their surroundings to the front and sides. Unfortunately, the shelters are often large and bulky to transport to the hunting sight. Unlike the insulated mats, the shelters take considerable time and skill to set up and take down. The shelters are also expensive. Due to the design of the shelters, often in a tent like fashion, the shelters limit the view of the hunter to the openings in the shelter and can inhibit the positioning of his or her weapon for discharge.

What is needed, therefore, is an article of commerce that is small, inexpensive, portable, and comfortable while providing maximum viewing of the surrounds for the hunter and proper positioning for weapon discharge.

SUMMARY OF INVENTION

The invention is an article of commerce comprising a mat and a support. The mat has a distal edge and a proximal edge. The proximal edge is longitudinally spaced from the distal edge in a first longitudinal direction. The support is attached to the mat along the proximal edge of the mat. The support has an inclined upper surface that slopes upwardly from the mat in the first longitudinal direction.

DETAILED DESCRIPTION OF THE INVENTION INCLUDING A BEST MODE

| Nomenclature | |
|---|---|
| 10 | Article of Commerce |
| 20 | Mat |
| 21 | Distal Edge of Mat |
| 22 | Proximal Edge of Mat |
| 23 | Top Surface of Mat |
| 25 | First Side of Mat |
| 26 | Second Side of Mat |
| 30 | Support |
| 31 | Upper Surface of Support |
| 32 | Lower Surface of Support |
| 40 | Cover |
| 50 | Closure |
| 60 | Reclining Space |
| 70 | Storage Chamber |
| 80 | Fold Line |
| 90 | Catch Mechanism |
| 101 | First Flap |
| 102 | Second Flap |
| $x_1$ | First Longitudinal Direction |

Definitions

As utilized herein, the phrase "reclining space" refers to a space between two surfaces that are in contact but not adhered or affixed at all points of contact between the two surfaces so as to allow another object to be introduced between the two surfaces where they are not adhered or affixed.

Construction

Figure 1:
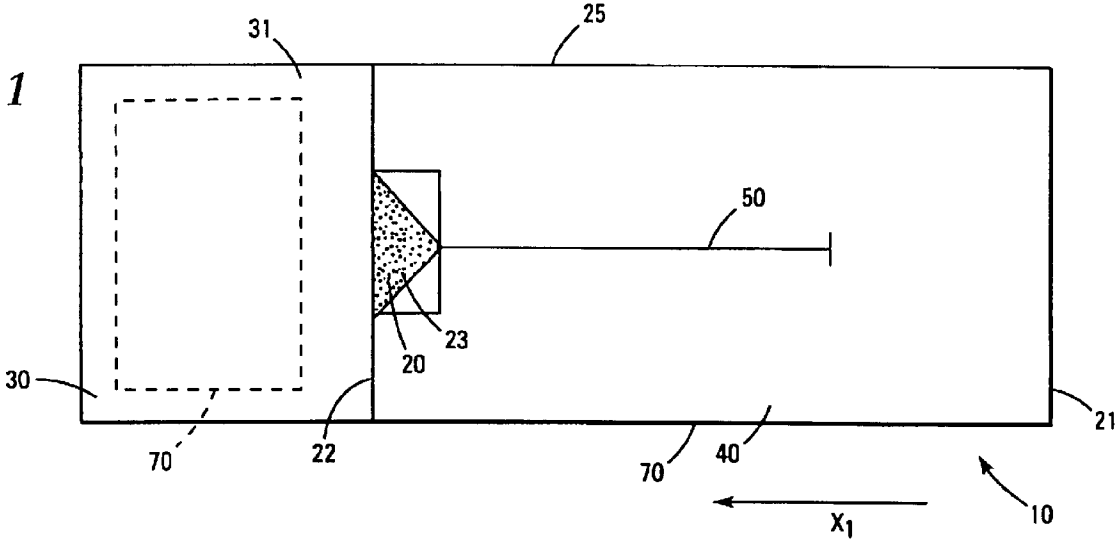
FIG. 1 is a top view of one embodiment of the invention.

The article of commerce 10 can be used by hunters (not shown) as a barrier between them and the cold, damp ground (not shown). As shown in FIG. 1, one embodiment of the article of commerce 10 comprises a mat 20 and a support 30. The mat 20 may be constructed from any number of suitable materials that provide a moisture barrier between the hunter and the ground. The preferred material is insulated Gortex® fabric. The mat 20 may also have a cushioned core (not numbered) between two layers of the moisture barrier material. The cushioned core may be any number of suitable materials, including, feathers, cotton batting, rubber, air, with a preference for foam. The mat 20 has a distal edge 21, a proximal edge 22, a first lateral side 25 and a second lateral side 26. The proximal edge 22 is longitudinally spaced from the distal edge 21 in a first longitudinal direction $x_1$. As shown in FIG. 1 the preferred configuration of the mat 20 is a rectangular shape with the proximal edge 22 and distal edge 21 being the shorter sides of the rectangular shape.

Figure 3:
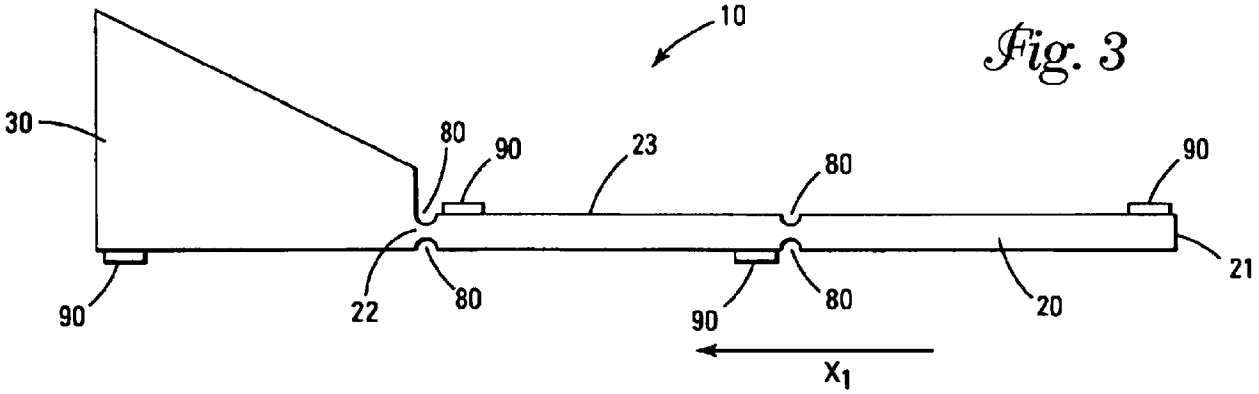
FIG. 3 is a side view of another embodiment of the invention.
Figure 4:
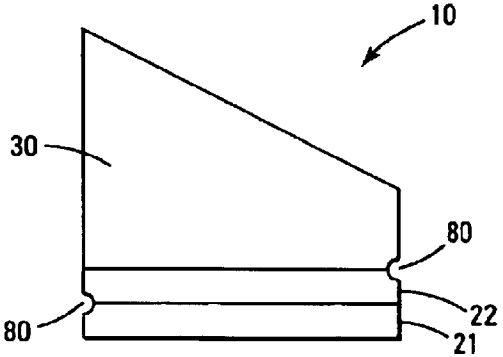
FIG. 4 is a side view of the invention shown in FIG. 3 in the storage position.

As shown in FIG. 3, another embodiment of the mat 20 may have a lateral fold line 80 proximate the longitudinal center of the mat 20. Alternately the mat 20 may have a plurality of longitudinally and equidistantly spaced equidistant lateral fold lines 80. Preferably, the set of fold lines 80 is two individual fold lines 80. As shown in FIG. 4, the fold lines 80 may be used to fold the mat 20 into sections allowing the mat 20 to be neatly and completely folded under the support 30 and then secured with a catch mechanism 90, such as snaps, buttons, hooks and eyes, buckles, or laces, with a preference for Velcro®, to allow easier transport and storage of the article of commerce 10.

The mat 20 may also have a cover 40 attached to it. The cover 40 may be made from an insulated or a non-insulated material. The choice would depend on the season the mat 20 is being used. Preferably the cover 40 is a light weight, insulated material that provides heat retention yet is not too bulky. In one embodiment, as shown in FIG. 1, the cover 40 may be fixedly or removably attached to the mat 20 along the distal edge 21 of the mat 20 and the sides 25 and 26 of the mat 20. The cover 40 is not attached to the mat 20 along the proximal edge 22 of the mat 20 to allow a hunter to slide into the reclining space 60 between the top surface 23 of the mat and the cover 40. The cover 40 may also contain a longitudinally extending closure 50 to allow an opening for the hunter to more easily access the reclining space 60. As shown in FIG. 1, the closure 50 may be any suitable mechanism including, Velcro®, snaps, buttons, hooks and eyes, buckles, or laces, with a preference for a zipper. The closure 50 may provide a large opening for the hunter to enter and exit the reclining space 60 more easily.

Figure 5:
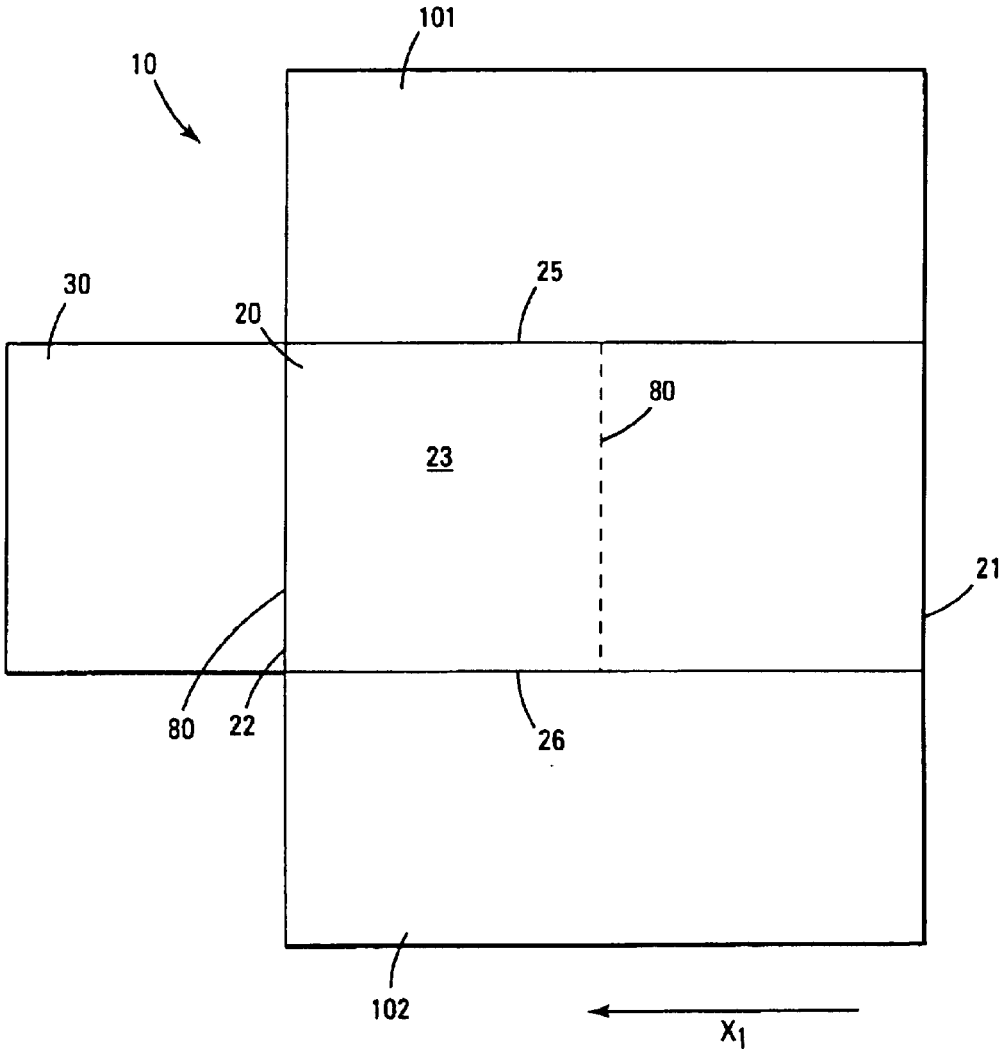
FIG. 5 is a top view of another embodiment of the invention.

An alternative embodiment of cover 40 is shown in FIG. 5, where the cover 40 is constructed of two separate pieces of material 101 and 102. One section 101 is attached to the mat 20 along the first lateral side 25 of the mat 20 and the other section 102 is attached to the mat 20 along the second lateral side 26 of the mat 20. This allows the cover 40 to act as a set of flaps 101 and 102 to cover the hunter while on the top surface of the mat 23 and in the reclining space 60. Having the cover 40 constructed of a set of flaps 101 and 102 allows the hunter easier access to the reclining space 60.

The cover 40 may be made from a camouflaged colored and patterned fabric or material. This may facilitate the hunter blending into the surroundings so the wildlife is less able to see him or her.

As shown in FIGS. 1–5, the article of commerce 10 has a support 30. The support 30 is attached to the mat 20 along the proximal edge 22 of the mat 20. The support 30 has an inclined upper surface 31 that slopes upwardly from the mat 20 in the first longitudinal direction $x_1$. The support 30 may be constructed from any suitable material that provides adequate support for the head and shoulders of a hunter as the hunter reclines upon the mat, including plastic cotton-batting, and pressurized air. Preferably the support 30 is constructed of foam.

Figure 2:
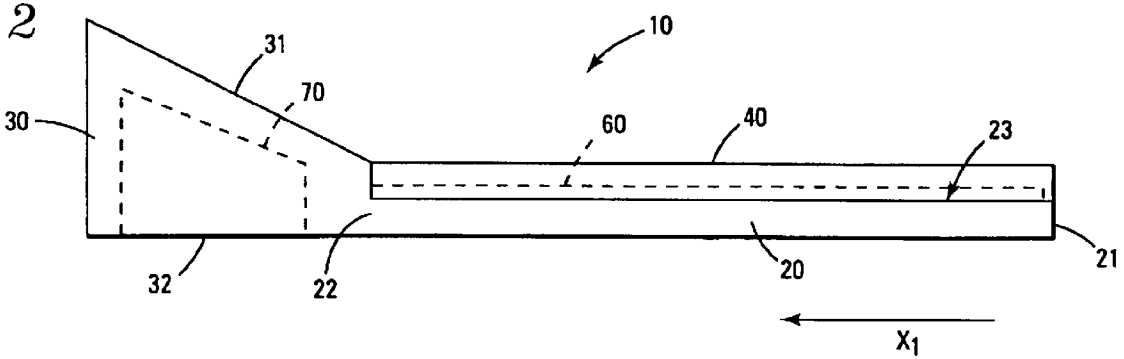
FIG. 2 is a side view of the invention shown in FIG. 1.

As shown in FIGS. 1 and 2, one embodiment of the support 30 of the article of commerce 10 may define a storage chamber 70. The storage chamber 70 may be accessible through the lower surface 32 of the support 30. This could allow the hunter to have extra storage space for hunting gear or provisions while using the article of commerce 10. The storage chamber 70 may also be used to store the mat 20 portion of the article of commerce 10 when the article of commerce 10 is being stored or transported.

Use

The article of commerce 10 is preferably used by hunters as a barrier between them and the cold and damp, irregular ground. The mat 20 may provide a moisture barrier between the ground and the hunter lying or sitting atop the mat 20. The mat 20 may also contain a cushioned layer to provide added comfort to the hunter that is lying or sitting upon the mat 20 for an extended period of time. The mat 20 may also have a cover 40 attached to provide a reclining space 60 between the cover 40 and the top surface 23 of the mat 20. As the cover 40 may then lie atop the hunter it may provide additional protection from the weather for the hunter and help keep the hunter warm. The cover 40 may also be made from or decorated with camouflage colored and patterned fabric or material so as to help the hunter blend into the surroundings. A closure 50 in the cover 40 may also provide convenience and ease in accessing the reclining space 60.

The support 30 portion of the article of commerce 10 may have several functions for the hunter. The support 30 may be used by the hunter to lean against as he or she lies upon the mat 20. This could put the hunter in a more upright position to make discharging the weapon easier more accurately. The support 30 may also be used by a hunter lying on his or her stomach as a support or guide for a weapon.

As shown in FIGS. 1 and 2, the support may also define a storage chamber 70. The storage chamber 70 may be accessible through the lower surface 32 of the support 30. This may allow the hunter to store food or other provision while using the article of commerce 10. The storage chamber 70 may also be used to store the mat 20 portion of the article of commerce 10. If the mat 20 is constructed from a flexible material it could be rolled up and inserted within the storage chamber 70. This method of storage for the mat 20 may make the article of commerce 10 easier to transport as the article of commerce 10 is then smaller and less awkward to maneuver.

As shown in FIGS. 3–5, the mat 20 may also contain a set of fold lines 80. The fold lines 80 are equidistant and laterally spaced to allow the mat 20 to be folded neatly and completely under the support 30 and secured in place with a catch mechanism 90. This method of storage for the mat 20 may also make the article of commerce 10 easier to transport as the article of commerce 10 is then smaller and less awkward to maneuver.

I claim:

1. An article of commerce, comprising:

(a) a mat having (i) a distal edge, (ii) a proximal edge longitudinally spaced from the distal edge in a first longitudinal direction, (iii) opposed lateral sides, and (iv) at least one lateral fold line, (b) a support attached to the mat along the proximal edge of the mat having an inclined upper surface that slopes upwardly from the mat in the first longitudinal direction, and (c) a pair of overlapping flaps with each flap attached to a lateral side of the mat.

2. The article of commerce recited in claim 1, wherein the support defines a storage chamber accessible through a lower surface of the support.

3. The article of commerce as recited in claim 1, wherein the at least one lateral fold line is positioned proximate the longitudinal center of the mat.

4. An article of commerce, comprising:

(a) a mat having (i) a distal edge, (ii) a proximal edge longitudinally spaced from the distal edge in a first longitudinal direction, (iii) opposed lateral sides, and (iv) a set of longitudinally and equidistantly spaced lateral fold lines, (b) a support attached to the mat along the proximal edge of the mat and having an inclined upper surface that slopes upwardly from the mat in the first longitudinal direction, and (c) a pair of overlapping flaps with each flap attached to a lateral side of the mat.

* * * * *